United States Patent [19]

Hugenbruch

[11] 4,109,493

[45] Aug. 29, 1978

[54] DRUM-TYPE MACHINE FOR THE TREATMENT OF TEXTILE MATERIAL

[76] Inventor: Ernst Hugenbruch, Glockenstrasse 25, 4000 Düsseldorf, Fed. Rep. of Germany

[21] Appl. No.: 660,276

[22] Filed: Feb. 23, 1976

[51] Int. Cl.[2] ..... D06F 31/00

[52] U.S. Cl. ..... 68/27; 34/129; 68/140; 68/210

[58] Field of Search ..... 68/27, 58, 139, 140, 68/142, 143, 144, 145, 158, 210; 34/129, 216, 217

[56] References Cited

U.S. PATENT DOCUMENTS

| | | | |
|---|---|---|---|
| 649,152 | 5/1900 | Annandale | 68/58 |
| 2,056,803 | 10/1936 | Failing | 68/158 X |
| 3,247,690 | 4/1966 | Kahn | 68/143 X |

FOREIGN PATENT DOCUMENTS

| | | | |
|---|---|---|---|
| 2,424,509 | 1/1975 | Fed. Rep. of Germany | 68/145 |
| 655,729 | 8/1951 | United Kingdom | 68/142 |

*Primary Examiner*—Philip R. Coe
*Attorney, Agent, or Firm*—Craig & Antonelli

[57] ABSTRACT

A drum-type machine for thermal dry or wet treatment of textile material including a rotatable, approximately horizontal drum surrounded by a fixed housing and connected with a drive mechanism via a traction device, the drum being charged and unloaded axially. Two radially externally disposed bearings are provided at an axial spacing at the drum with the traction device being placed about the drum between the bearings in order to transmit driving force to the drum. The traction device contacts the drum along the outside surface thereof.

16 Claims, 11 Drawing Figures

FIG. 1
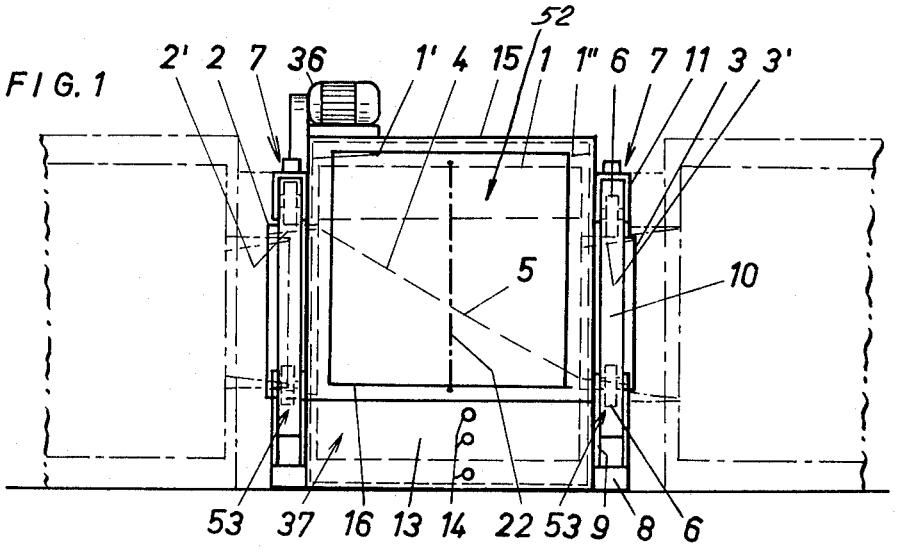
FIG. 2
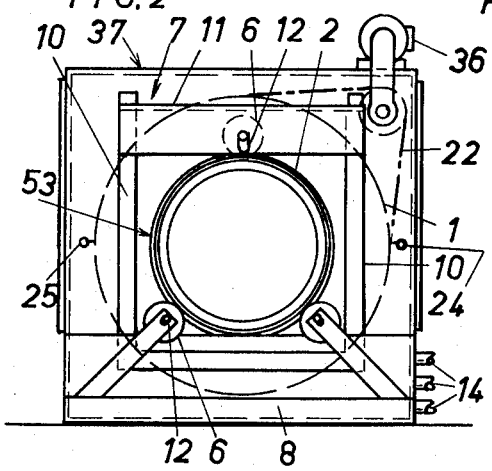
FIG. 3
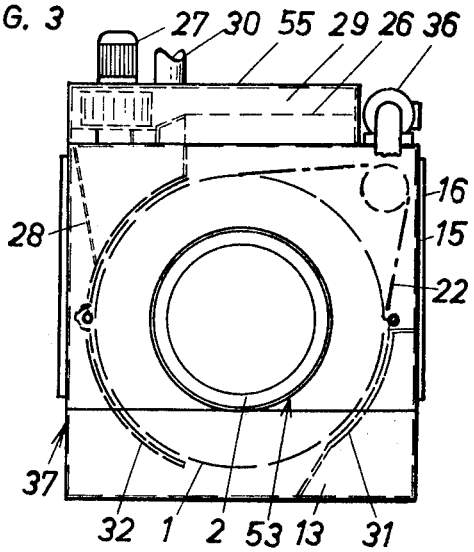
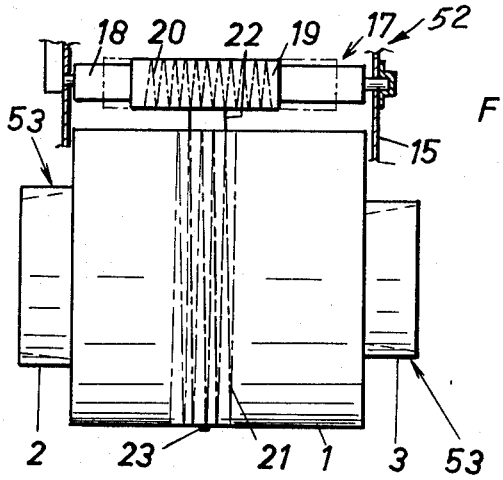
FIG. 4
FIG. 5
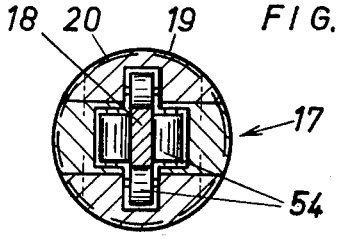

DRUM-TYPE MACHINE FOR THE TREATMENT OF TEXTILE MATERIAL

The invention relates to a drum-type machine for the thermal dry or wet treatment of textile material, comprising a rotatable, approximately horizontal drum surrounded by a fixed housing and connected, by way of a traction means, with a drive mechanism, this drum being charged and unloaded axially.

Washing machines for textile piece goods have been known wherein a number of individual drum-type machines, joined together by conveying means, are arranged in series. This system is expensive in its construction and in its space requirement, due to the large number of conveying means. Moreover, the batch of material is periodically exposed to a shock-like interruption of the treatment during transport. Furthermore, continuous washing machines are known for the batch-side laundering of textile material with partitions and ducts to move and convey the batches of goods. In this arrangement, the drum executes, for the washing treatment, a reversing rotation of less than one full revolution and, for the conveying step, a rotation of more than one full revolution. These washing machines consist of a single, long drum equipped with the necessary chambers for the prewash, the final wash, and for rinsing. The length of such a drum is adapted to the amount to be laundered and cannot be varied. Therefore, the washing work must be predetermined. Drums of such a length are furthermore expensive in their manufacture and can only be considered as a unit in case of possible repairs. Since the drum drive is effected from a single motor, the entire mass of the drum and the material disposed therein must be accelerated at the same time, whereby high power and correspondingly high amperages are required. The drum has heretofore been driven by a gear transmission and/or by a chain or friction drive gear. The former require lubrication and thus must be arranged outside of the treatment medium; consequently, the power is effective unilaterally at one end of the long drum. In contrast thereto, the friction drive gear must be maximally dry in order to maintain the friction effect. Finally, in all conventional drum-type machines, the reversing angle can be maintained with a reasonable degree of accuracy only with a considerable expenditure of control means. Finally, drum-type washing machines are known comprising several drums in fixed housings flanged together, wherein between adjacent housings respectively two partitions are provided. These washing machines are voluminous in their structure and thus are expensive.

Accordingly, it is an object of the invention to avoid the aforedescribed disadvantages and yet to equip the drum-type machine with a maximally simple structure for versatile utilization.

This object is attained by this invention in that two bearings mounted radially on the outside are provided at an axial spacing at the drum, and the traction means for the drive transmission is placed about the drum between the bearings and contacts the outside of the drum jacket.

A particularly expedient construction results, in a further embodiment of the invention, by arranging the bearings at the ends of the drum or in the proximity thereof and by disposing the traction means essentially in the center of the drum.

The advantages attained by the invention reside particularly in that the drum bearing and the drum drive mechanism are arranged in an extremely suitable fashion and are of a simple structure so that just as simple a total construction is produced. Due to the large diameters present in the bearings and at the points where the power is effective on the drum, the thus-occurring loads are minor and consequently these machine parts are rugged and have a long lifetime. The traction means can readily be chosen to be components insensitive to temperature, moisture, and other influences occurring during the treatment of the textile material. Thus, the servicing of the drive mechanism is very simple, so that the drum-type machine in total likewise has no maintenance problems. Accordingly, the drum-type machine of this invention is suitable for all kinds of textile material treatments and can be used universally individually or in a combination of several units.

Embodiments of the invention are illustrated in the drawings and will be described in greater detail below. In the drawings:

FIG. 1 shows a lateral view of the drum-type machine;

FIG. 2 shows an end view of the drum-type machine on the inlet side;

FIG. 3 shows an end view of a dryer of the drum type;

FIG. 4 shows the drive system of the drum-type machine;

FIG. 5 shows a section through the drive shaft;

Figure 6:
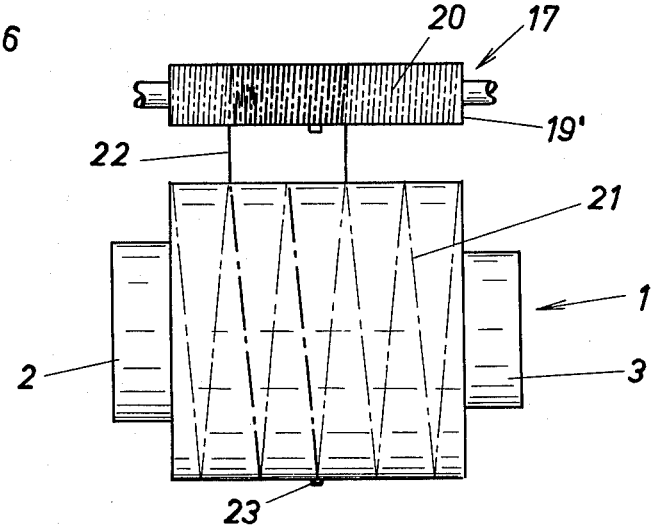
FIG. 6 shows another embodiment of the drive system.

The drum-type machine according to FIGS. 1 and 2 comprises an approximately horizontally supported drum 1, the end faces 1' and 1'' of which are equipped at one end with an inlet connection pipe 2 and at the other end with an outlet connection pipe 3. Both pipes 2 and 3 have openings for the axial charging and unloading of the drum 1. The conveying direction according to FIG. 1 extends from the left-hand side to the right-hand side. In the drum 1, one or more ribs 4 and a conveying duct 5 are provided forming a vane-type conveyor duct. The duct conveys the batch of material, in the final position of the drum, according to FIG. 1 through the opening in the outlet connection pipe 3 from the drum 1. To support the conveying action, the inlet and outlet connection pipes 2 and 3 are equipped with conical internal walls 2' and 3' flaring in the transporting direction. The diameters of the connection pipes 2 and 3 are furthermore adapted to each other so that the outlet connection pipe 3 can be inserted with a minimum of clearance in the inlet connection pipe 2, as shown in dot-dash lines in FIG. 1.

The two connection pipes 2 and 3 serve simultaneously as bearings 53 for the drum 1 and are, for this purpose, supported on rollers 6. These rollers 6 are mounted to respectively one frame 7 in close proximity to the end faces of the drum 1. Each frame 7 can have a profile 8 lying on the ground transversely to the drum 1 and provided with holding means 9 attached to both ends and pointing approximately toward the drum axis. Each holding means 9 carries a roller 6 at its upper end. The two holding means 9 are connected by a U-shaped supporting frame 10 which is open at the top and extends on both sides of the respective connecting pipe 2 or 3 in the upward direction. A preferably likewise U-shaped connecting member 11 is attached and threadedly mounted to the legs of this U-shaped frame. Each frame 7 represents a unitary part provided with slotted holes 12 or the like for the radial adjustment of the rollers 6 to the respective diameter of the inlet or outlet connection pipe 2 or 3.

A botton trough 13 is arranged between both frames 7 and is joined to the latter and the drum 1 is partially immersed in this trough. The top edge of the trough terminates preferably below the connection pipes 2 and 3. For the wet treatment of the textile material, this bottom trough 13 is fashioned as a container for the liquid and is equipped with feeding means 14 for the liquid, such as water and treatment medium, as well as for the heating means, e.g. steam. A top housing 15 is placed on the bottom trough and connected thereto, so that an essentially closed housing 37 surrounding the drum 1 is created, the interior of which is accessible by lateral doors 16 or the like.

To drive the drum, a drive mechanism 52 is provided with a drive shaft 17 arranged in parallel to the axis of the drum 1 and supported at the two end walls of the top housing 15. This drive shaft can consist, according to FIG. 5, of an angular, e.g. rectangular, profiled shaft 18 on which is guided a bushing 19 in an axially readily displaceable manner, for example by means of roller bearings 54, but fixed in the rotating direction, so that a rotationally rigid, but axially adjustable bearing is produced. A groove 20 is turned into the periphery of the bushing 19 in a spiral on screw thread configuration. The periphery of the drum 1 has a corresponding groove 21. A traction means 22, for example in the shape of a wire cable, lies in these grooves 20 and 21. The traction means is looped arouund the drum 1 by at least two windings and by a correspondingly larger number of windings about the bushing 19, in such a manner that the entering and leaving run of the traction means 22 linearly engages the grooves 20 and 21. The pitches of the two grooves 20 and 21 are likewise adapted to each other along these lines. The differing axial feed by the traction means 22 produced during the rotation of the drum is compensated for by the sleeve 19 by axial displacement, as indicated in dot-dash lines in FIG. 4. The traction means 22 is connected to the drum 1 at a fixed point 23. The drive shaft 17 is driven by a motor 36 arranged on the top housing 15.

An abutment mounted to the traction means 22 can serve for controlling the rotary motion of the drum 1. However, as illustrated, the fixed point 23 can also be fashioned as this abutment, actuating lateral feelers 24 and 25 (FIG. 2) while passing thereby, thus effecting the reversal of the drum rotation. Once a time-controlled treatment cycle has been completed, the feeler lying in the direction of rotation suitable for the transport, for example the feeler 24, is electrically changed over so that the drum 1 continues its rotation until reaching the feeler 25. The feeler 25 is reversed in its polarity by the same switching step, so that the direction of rotation is reversed only at this point in time, and the normal reversing process is again initiated by the actuation of the feeler 24 during the return motion.

The same structural elements can be combined to form a drum-type machine for the thermal drying treatment, as can be seen from FIG. 3. In this structure, an attachment 55 is placed on the top housing 15 comprising an air heater 26 and a blower 27 connected in front thereof which feeds the air sucked from the interior of the housing and purified by a lint filter 28 through a duct 29 to the air heater 26. A portion of the air stream escapes via an exhaust pipe 30. To conduct the air from the air heater 26 through the drum 1, baffles 31 and 32 are provided so that the air stream must flow from the top toward the bottom through the interior of the drum and on one side externally again in the upward direction. The drum 1 is driven by means of the motor 36 as described above.

Figure 7:
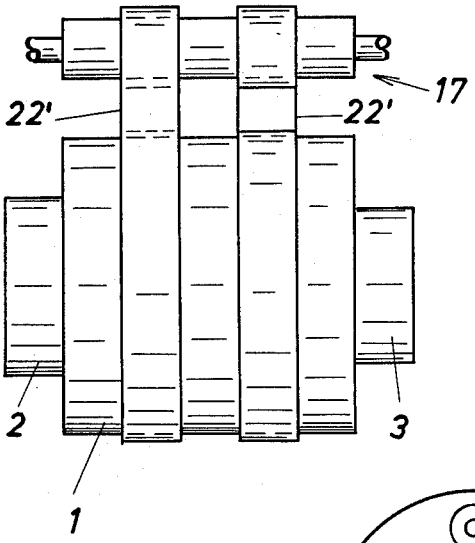
FIG. 7 shows a further embodiment of the drive system.
Figure 8:
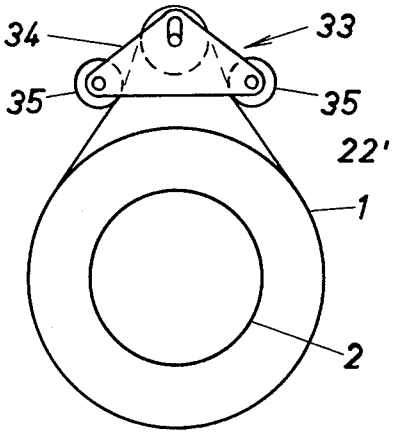
FIG. 8 shows an end view of the drive system according to FIG. 7.
Figure 9:
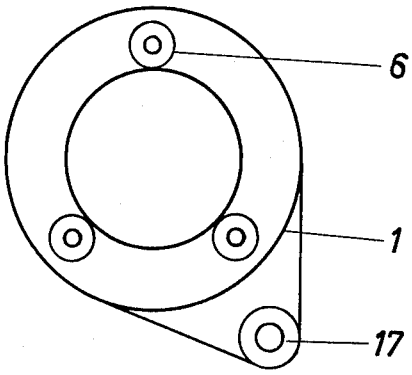
FIG. 9 shows a different correlation of the drive elements.

The pitch of the grooves 20 and 21, respectively, can also be adapted so that the lateral movement of the cable-type traction means 22 on the drum 1 and on the bushing 19' takes placed uniformly, as can be seen from FIG. 6. In this arrangement, the bushing 19' is mounted to be axially fixed. The traction means can furthermore be shaped like a belt 22', according to FIGS. 7 and 8. Two betls 22' are provided wound upon the bushing 19' and on the drum 1 in opposite directions. Since one belt 22' always unwinds while the other is wound up, the differences in diameter are essentially compensated for. Additionally, a belt tensioning means 33 can be provided consisting of plates 34 mounted to be vertically movable in slotted holes. Rolls 35 are rotatably disposed between these plates and rest on both belts 22'. By the inherent weight of the belt tensioning means 33, possibly enhanced by spring force, both belts 22' are kept in constant tension. The drive shaft 17 to drive the drum 1 can also be arranged as desired, for example essentially below the drum 1, as shown in FIG. 9. In case the machine is used as a single unit, the openings in the end walls 39 (FIG. 10) can also be adapted to be closed off by doors, flaps, or the like. Of course, the drum 1 can also have only a single opening for the charging and unloading operations. Likewise, the connection pipes 2 and 3 can be omitted, and the drum 1 can be mounted directly along the drum periphery.

The drum-type machine according to this invention can, finally, be utilized as an individual unit as well as in a gang-type arrangement one behind the other. For this purpose, several individual machines are disposed in axial succession wherein the outlet connection pipe 3 extends into the inlet connection pipe 2 of the subsequent drum-type machine, as indicated in FIG. 1. In this way, the drum-type machines can be set up, depending on the requirements and purpose of use, to provide any desired amount of power, or the machine size can be adapted to the respectively desired efficiency at any time, even subsequently. Since each drum-type machine is built up of standard components, any storage of replacement parts is easy. Also, an individual machine can be exchanged without difficulties. Since in case of several drum-type machines the switching operations of the motors can be staggered chronologically, the load on the mains is minor. Finally, each individual machine can conduct its own type of treatment in accordance with the temperature and composition of the treatment medium, e.g. the washing bath or the dyeing liquor.

It is finally possible to construct the drum 1 to be smooth, i.e. without a shoulder at the end faces, so that a continuous flow of material is obtained in a combination machine. Additionally, each drum-type machine can have its own inclined position for the conveyance of the material.

Figure 10:
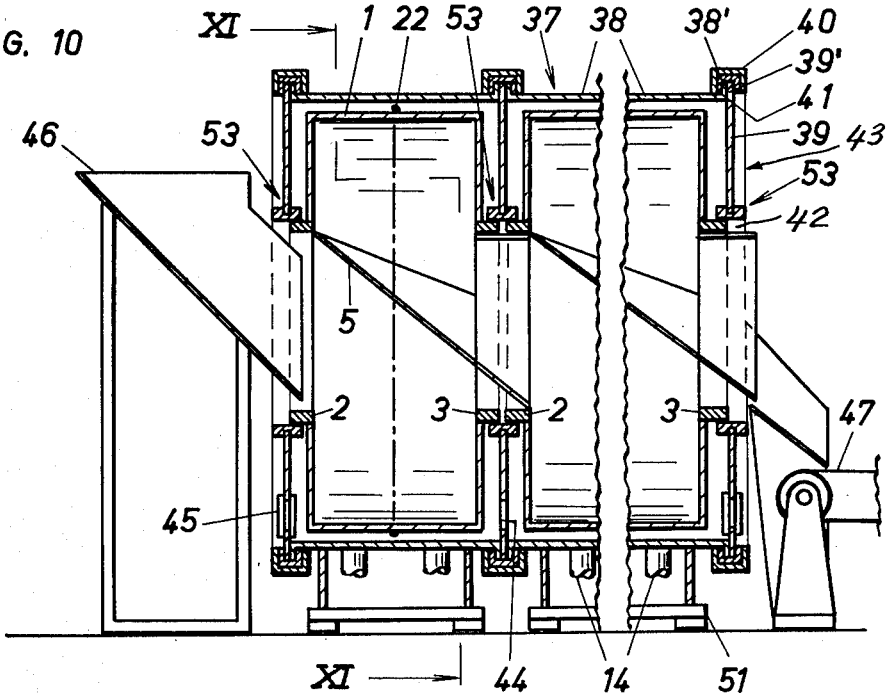
FIG. 10 shows a longitudinal section through another embodiment.
Figure 11:
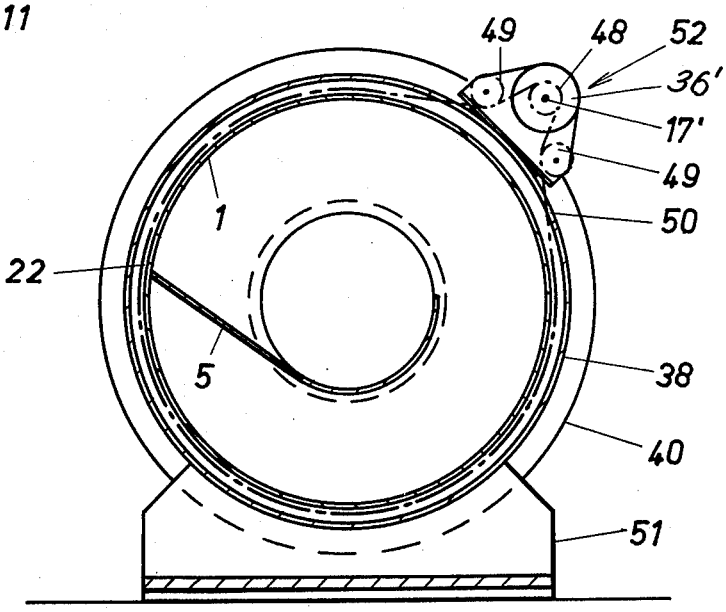
FIG. 11 shows a sectional view along line XI—XI of FIG. 10.

In the embodiment according to FIGS. 10 and 11, the drum 1 set into rotation by the traction means 22 is supported in a housing 37 having a cylindrical jacket 38 enclosing the drum 1, the end faces of this jacket being closed off by respectively one end wall 39. The cylindrical jacket 38 and the end wall 39 have radial, mutually associated annular surfaces 38' and 39' on the outer rim; these surfaces contact each other and are held by means of a fastening element fashioned as a U-shaped ring 40 with a sealing means 41 inserted therein. Each end wall 39 has centrally an opening 42 surrounded by a bearing shell 43 attached to the end wall 39. Into the bearing shell 43 extends, depending on the arrangement, the inlet connection pipe 2 and/or the outlet connection pipe 3 fashioned as a counter bearing. The bearings 53 of the drum 1 are fashioned as sliding bearings and consist of a material suitable for this purpose, especially a synthetic resin. Suitably, the bearing shells 43 are of such a length that the inlet and outlet connection pipes 2 and 3, having identical diameters, are carried together by one bearing shell 43 when several drum-type machines are arranged in axial succession. In this connection, adjacent cylindrical jackets 38 of the housings 37 are joined firmly and rigidly with each other with the interposition of a single end wall 39 by means of a common ring 40 with a seal 41, so that each housing 37 can accommodate a liquid. The cylindrical jacket 38 can be equipped with the inlet means 14, and the end wall 39 can be provided in the lower zone with an opening 44 which is tightly closed by a sealing device 45 in case of nonuse. It can be seen that also in this embodiment the drum-type machine consists of standard parts. Thus, the cylindrical jacket 38 can be combined, depending upon requirements, with an end wall 39 to form an individual drum-type machine or a multiple-drum-type machine. To feed the batches of material, a filling hopper 46 can be provided, and a conveyor belt 47 can be arranged at the end of the machine to discharge the finished batches.

The drum is driven by a closed traction means 22 wound about the drum 1 and about a drive wheel 48 seated on the drive shaft 17' of the motor 36'. Guide wheels 49 maintain the traction means 22 under tension and effect a large looping angle. The traction means 22 can be fashioned, for example, as a chain contacting the smooth periphery of the drum, whereas a sprocket wheel can be provided as the drive wheel 48. The entire drive mechanism 52 is attached to the outside of the cylindrical jacket 38, the latter having a slot-like aperture 50 to allow the traction means 22 to pass therethrough. The cylindrical jacket 38 rests on a frame 51.

In a further embodiment of the invention, the housing 37 can also be equipped with an end wall 39 which is non-detachably mounted, whereas the other end wall can be inserted. Thus, it is possible, for example, to connect the forward end wall 39 fixedly to the cylindrical jacket 38, while the rear end face is open. In this way, one or more drum-type machines can be arranged in series and combined into a single machine, wherein the respectively open end face of a cylindrical jacket 38 is closed off by the end wall 39 of the neighboring, closed cylindrical jacket 38, and the open end face of the last cylindrical jacket 38 is closed off by a loose end wall 39. The size of the machine can thus be increased, starting with a single unit, up to a large number of such units. Each machine unit represents a fully functional machine except for the open end face, the housing 37 of which is completed by composing the units into a combination and/or by the insertion of an end wall 39. As the separating means between adjacent machine units, there is in all cases merely a single end wall 39.

It is finally possible, furthermore, to fashion the drum 1 with a nonperforated drum shell, so that it thus can receive the treatment liquid directly, and the housing 37 serves practically only as a support for the bearings 53 of the drum 1.

I claim:

1. Drum-type machine for the thermal dry or wet treatment of textile material, comprising at least one rotatable, approximately horizontal drum having an axis, an outside surface and two end walls, the drum being surrounded by a nonrotatable housing with end walls, a drive mechanism connected with the drum by a drive means, characterized in that two radially externally exposed bearings spaced from one another in the axial direction of the drum are provided at least in the proximity of the end walls of the drum, the drive means being placed about the drum between the bearings approximately in the center of the drum for contacting the outside surface of the drum and for transmitting the drive force to the drum, the end walls of the drum being provided with central openings for charging and unloading of the textile material, the openings being surrounded by connection pipes forming a portion of the bearings, the bearings being fashioned as slide bearings including bearings shells integral with the end walls of the housing, and further comprising a plurality of drums supported in housings and arranged one behind the other in axial alignment with common bearing shells between adjacent drums, the bearing shells cooperating with the connection pipes of two adjacent drums for forming a sliding bearing thereat.

2. Drum-type machine according to claim 1, characterized in that the nonrotatable housing has a cylindrical jacket surrounding the drum, the jacket having end faces closed off with respectively one end wall having a bearing aperture therein, and fastening and sealing means being provided for the detachable mounting of the end wall to the cylindrical jacket.

3. Drum-type machine according to claim 2, characterized in that the cylindrical jacket and the end wall having mutually associated radial annular surfaces connected with each other by a U-shaped ring with a sealing means inserted therein, which ring serves as the fastening means.

4. Drum-type machine according to claim 1, characterized in that the openings are smaller than the diameter of the drum, and a vane-type conveyor duct is arranged in the drum for transporting a batch of material through one of the openings.

5. Drum-type machine according to claim 1, characterized in that the drive means is joined at a fixed point means to at least one of the drum and a drive shaft of the drive mechanism, the fixed point means effecting a reversing drive operation.

6. Drum-type machine according to claim 5, characterized in that the drive means is wound about the drum and the drive shaft in the manner of a screw thread.

7. Drum-type machine according to claim 5, characterized in that the drive shaft has a bushing axially displaceably mounted on a profiled shaft and is fixedly mounted for rotation with the profiled shaft in the rotational direction.

8. Drum-type machine according to claim 7, characterized in that the drum has a thread-like groove and at least one of the drive shaft and the bushing have a thread-like groove, the thread pitches of the grooves being adapted to each other in the relationship of the transmission of at least one of the drive shaft and bushing with respect to the drum.

9. Drum-type machine according to claim 1, characterized in that the housing has at least one of inlets and discharge means for at least one of the treatment media and heating media and carries the drive mechanism.

10. Drum-type machine according to claim 9, characterized in that the housing is constructed to receive an attachment with a blower and an air heater, and including baffles disposed in the zone of the drum to conduct the air, and lint filters arranged in the zone of the drum for purposes of air purification.

11. Drum-type machine according to claim 1 characterized in that one of the end walls forms a single end wall between adjacent housings, each housing being provided with a cylindrical jacket rigidly joined to a jacket of another housing by a fastening means.

12. Drum-type machine according to claim 11, characterized in that at least one of the single end wall and the other end wall of each housing is nondetachably connected to the cylindrical jacket of the housing and forming a closed end face of the jacket, the jacket having an open end face for joining to the closed end face of another cylindrical jacket.

13. Drum-type machine according to claim 1, characterized in that the drive means is fashioned as one of a chain means, cable means and belt means and contacts the smoothly constructed drum jacket.

14. Drum-type machine according to claim 1, characterized in that the drum has a nonperforated drum jacket.

15. Drum-type machine according to claim 1, characterized in that the approximately horizontal drum is maintained in the horizontal position for charging and unloading of the textile material.

16. Drum-type machine according to claim 1, characterized in that each drum is provided with a single vane-type conveyor duct for transporting a batch of material through each drum, and at least a respective drive means being provided for each drum.

* * * * *